US007321356B2

(12) United States Patent
Apte

(10) Patent No.: US 7,321,356 B2
(45) Date of Patent: Jan. 22, 2008

(54) TIME DOMAIN PRINTING FOR ELECTRIC PAPER

(75) Inventor: Raj B. Apte, Palo Alto, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 74 days.

(21) Appl. No.: 11/012,970

(22) Filed: Dec. 15, 2004

(65) Prior Publication Data

US 2006/0125778 A1 Jun. 15, 2006

(51) Int. Cl.
*G09G 3/34* (2006.01)

(52) U.S. Cl. ..... 345/107; 399/130; 347/264; 355/400

(58) Field of Classification Search ..... 345/84–109; 399/130; 347/264; 355/271, 400, 407; 358/474
See application file for complete search history.

(56) References Cited

U.S. PATENT DOCUMENTS

| | | | | |
|---|---|---|---|---|
| 4,126,854 | A | 11/1978 | Sheridon | |
| 5,389,945 | A | 2/1995 | Sheridon | |
| 5,515,144 | A * | 5/1996 | Miyasaka et al. | 358/452 |
| 5,717,418 | A * | 2/1998 | Shapiro et al. | 345/89 |
| 5,866,284 | A * | 2/1999 | Vincent | 345/107 |
| 5,961,804 | A | 10/1999 | Jacobson, et al. | |
| 5,975,680 | A * | 11/1999 | Wen et al. | 345/107 |
| 6,017,583 | A | 1/2000 | Gass | |
| 6,045,955 | A * | 4/2000 | Vincent | 345/107 |
| 6,222,513 | B1 * | 4/2001 | Howard et al. | 345/107 |
| 6,456,272 | B1 * | 9/2002 | Howard et al. | 345/107 |
| 6,587,250 | B2 | 7/2003 | Armgarth, et al. | |
| 6,670,981 | B1 * | 12/2003 | Vincent et al. | 347/264 |
| 6,768,889 | B2 * | 7/2004 | Ikegawa | 399/130 |
| 6,829,078 | B2 | 12/2004 | Liang | |
| 2004/0212600 | A1 * | 10/2004 | Kodama et al. | 345/173 |
| 2005/0128531 | A1 * | 6/2005 | Nota et al. | 358/474 |

FOREIGN PATENT DOCUMENTS

JP 2002296624 A * 10/2002

* cited by examiner

*Primary Examiner*—David L. Lewis
(74) *Attorney, Agent, or Firm*—Kent Chen

(57) ABSTRACT

An improved method and system for printing electric paper is described. The method utilizes a system for keeping a writing characteristic, such as an electric charge or an electric current, constant with each pixel of an electric paper as the electric paper moves through a system. By keeping the electrical characteristic constant at each pixel, as the electric paper moves, the throughput of an electric paper printing system is significantly enhanced.

24 Claims, 6 Drawing Sheets

TIME DOMAIN PRINTING FOR ELECTRIC PAPER

BACKGROUND

Electric paper is a re-writable medium that affords the convenience of paper in an electronic medium. In particular, electric paper is usually lightweight, thin and flexible and displays images indefinitely while consuming little or no power. Ideally, electric paper is also reusable and displays images using reflected light and allows a very wide viewing angle.

One form of electric paper is a gyricon system disclosed in various patents and articles such as U.S. Pat. No. 4,126,854 by Sheridon titled "Twisting Ball Display". The gyricon system includes a host layer a few millimeters thick that is heavily loaded with bichromal elements, possibly spheres, tens of microns in diameter. Each bichromal element has halves of contrasting colors, such as a white half and black half. Each bichromal element also possess an electric dipole, orthogonal to the plane that divides the two colored halves. Each bichromal element is contained in its own cavity filled with a dielectric liquid. Upon application of an electric field, the bichromal elements rotate depending on the polarity of the field presenting one or the other colored half to an observer. Other forms of electric paper include electrophoretic particles (such as U.S. Pat. Nos. 6,829,078 and 5,961,804) and electrochromic medium (such as U.S. Pat. No. 6,587,250).

One way to make electric reusable paper cheaper and enable the use of cheap flexible plastic films in packaging the electric paper is to completely remove the driving electronics from the electric paper. Instead, an "electric paper printer" includes external addressing electronics to write and erase images. This approach reduces the per unit cost of electronic paper sheets. Multiple electronic paper sheets can then be addressed by a single set of external driving electronics, much as multiple sheets of pulp paper are printed on by a single printer. Such a system is described in U.S. Pat. No. 6,456,272 entitled "Field Addressed Displays Using Charge Discharging in Conjunction with Charge Retaining Island Structures" which is hereby incorporated by reference in its entirety.

One problem facing the use of such external electric paper printers is that external addressing devices are limited by the slow response speed of electric paper optical display elements. In example bichromal element electric paper substrates, complete rotation of bichromal elements is achieved when the addressing electric field is maintained for the entire bichromal element rotation time, typically on the order of 400 milliseconds. For a sheet that includes many rows of an image, it could take many seconds or possibly minutes to print the entire image.

Thus a technique for enabling an electric paper printer to more rapidly output electric paper sheets is needed.

SUMMARY

An electric paper printer is described. The electrical paper printer includes a two dimensional array of electric paper printing elements. Each electrical paper printing element outputs an electrical characteristic. The electric characteristic sets the color of a pixel in the electric paper. The electric paper printer also includes a paper handler mechanism that moves a sheet of electric paper and creates a relative motion between the sheet of electric paper and the two dimensional array of electric paper printing elements.

A circuit adjusts the electrical characteristics of the two dimensional array of electric paper printer elements such that a particular electrical write characteristic approximately tracks a corresponding pixel of the electric paper for a duration of time that the corresponding pixel remains approximately adjacent the two dimensional array of electric paper printer elements.

DETAILED DESCRIPTION

A system for printing electric paper is described. The system moves an electrical characteristic used to write to the electric paper at a speed that approximately matches the electric paper speed. In one embodiment, the electrical characteristic is an electric field output by the printer.

Figure 1:
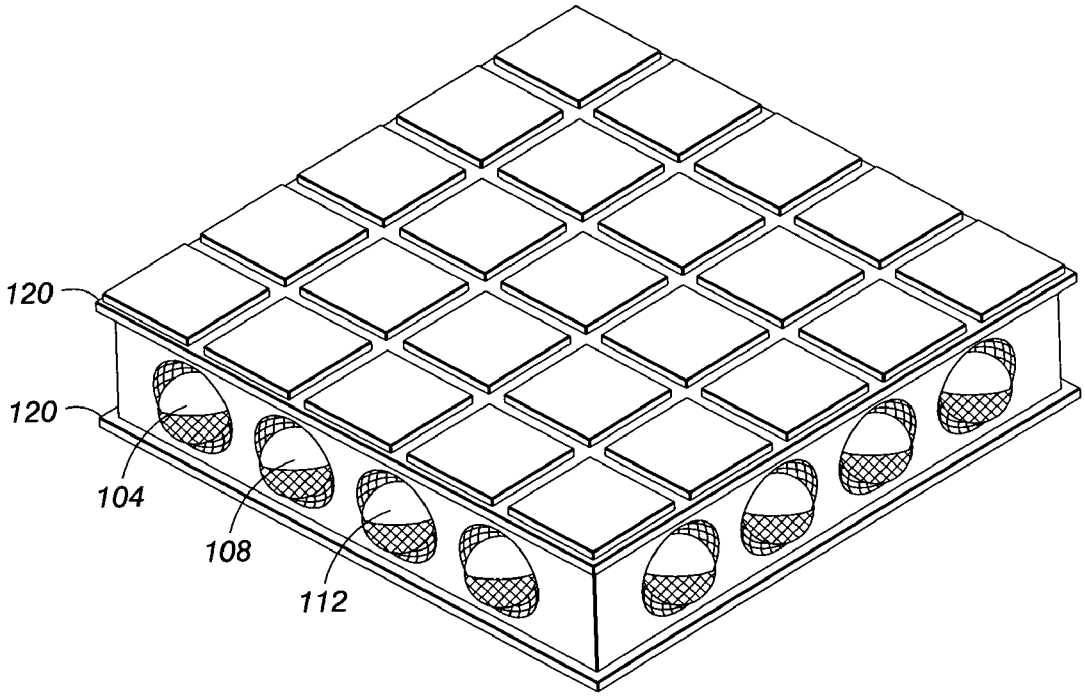
FIG. 1 (PRIOR ART)
FIG. 1 shows a cross sectional view of an example sheet of electric paper.

FIG. 1 shows a cross sectional view of an example sheet of electric paper. FIG. 1 shows a gyricon sheet 100 including a plurality of bichromal elements 104, 108, 112 patterned between a first encapsulating layer 116 and a second encapsulating layer 120. Although spherical bichromal elements are shown, cylindrically shaped elements may also be used. A complete discussion of twisting cylinder electric reusable paper substrates can be found in U.S. Pat. No. 5,894,367 which is hereby incorporated by reference.

Figure 2:
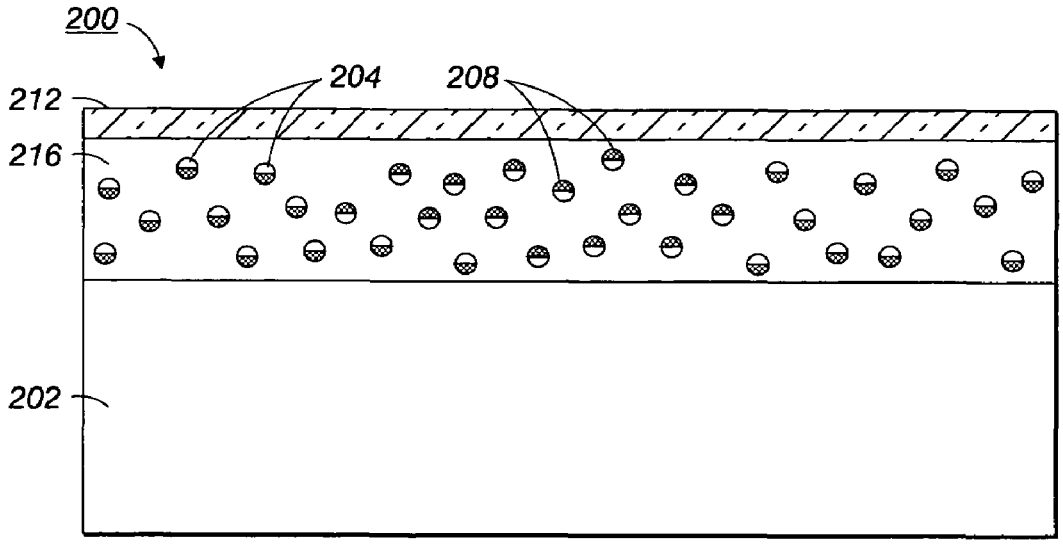
FIG. 2 (PRIOR ART)
FIG. 2 shows a cross sectional view of an alternative electric paper sheet.
Figure 3:
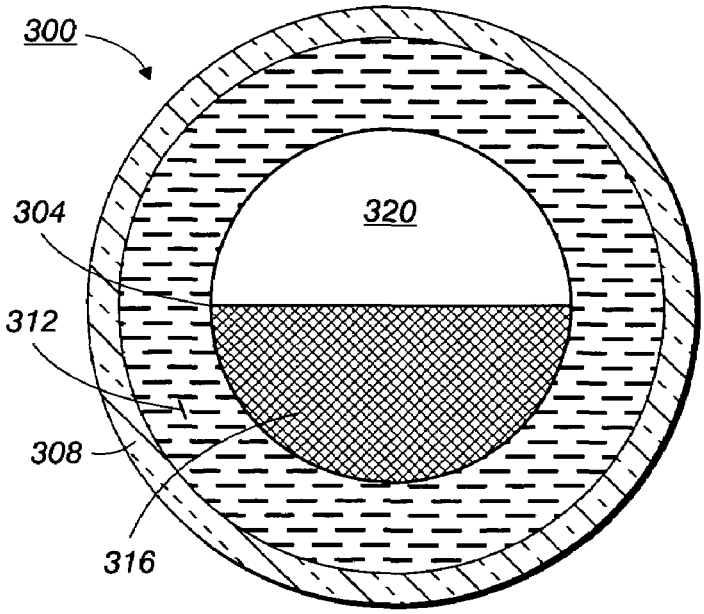
FIG. 3 (PRIOR ART)
FIG. 3 shows an expanded view of a microcapsule including a bicolored sphere.

FIG. 2 shows a cross sectional view of an alternative form of electric paper where microcapsule spheres formed in microcapsules 204 are suspended in a material. FIG. 3 shows the details of each microcapsule. Each microcapsule includes a microencapsulate shell 308 housing a bicolored sphere 304. A lubricating fluid 312 coats sphere 304. In a black and white display, sphere 304 includes a black hemisphere 316 and a white hemisphere 320. The sphere may be made from numerous elements, including pigmented glass, polymers or ceramic. In one embodiment, a charged black vapor coats one hemisphere of an otherwise white sphere. The vapor particles may provide both the black color as well as the charges to create an electric dipole in the sphere. A printer created external electric field uses the electric dipole to rotate the sphere.

A high enough density of microcapsules are included such that the electric paper appears a uniform color when all the spheres are rotated to a common position. A fixed polymer coating layer may be used to protect the electric surface. A printer applies a write characteristic, in this case an electric field, which passes through the polymer coating layer and rotates the microencapsulated spheres.

Other forms of electric paper may also be used. For example, U.S. Pat. No. 6,017,583 by E-Ink Corporation describes an electrophoretic material that may be used as an electric paper medium. The electrophoretic material includes particles that adjust to an applied electric field. The position of the particles determines the reflective characteristics. By appropriately positioning particles, an image can be made on the electric paper. The particle response time to an applied electric field limits the speed at which a printer can print to the electrophoretic electric paper.

An alternative electric paper has been developed by Ntera Corporation of Dublin, Ireland. The electric paper works on electrochromic principles. When a current passes through a pixel of the electrochromic paper, the current changes either the light transmissivity or color of the pixel. Thus an electric paper printer "prints" an image on electrochromic paper by selectively applying current to selected pixels on the paper.

Various techniques may be used to "print" on the different types of electric paper. In one embodiment, a laser printer structure is used to write onto an electric paper that is sensitive to electric fields. In a traditional laser printer, the charges on a laser printer drum are used to attract and control toner layout. In an electric paper laser printer, the charges are used to control electric paper elements, such as gyricon spheres, electrophoretic material and the like. U.S. Pat. No. 5,866,284 entitled "Print Method and Apparatus for Rewritable Medium" and assigned to Hewlett Packard corporation describes such a laser printer and is hereby incorporated by reference. However, the slow electric paper response time due to the slow sphere rotation or the electrophoretic response time renders such printing slow.

Figure 4:
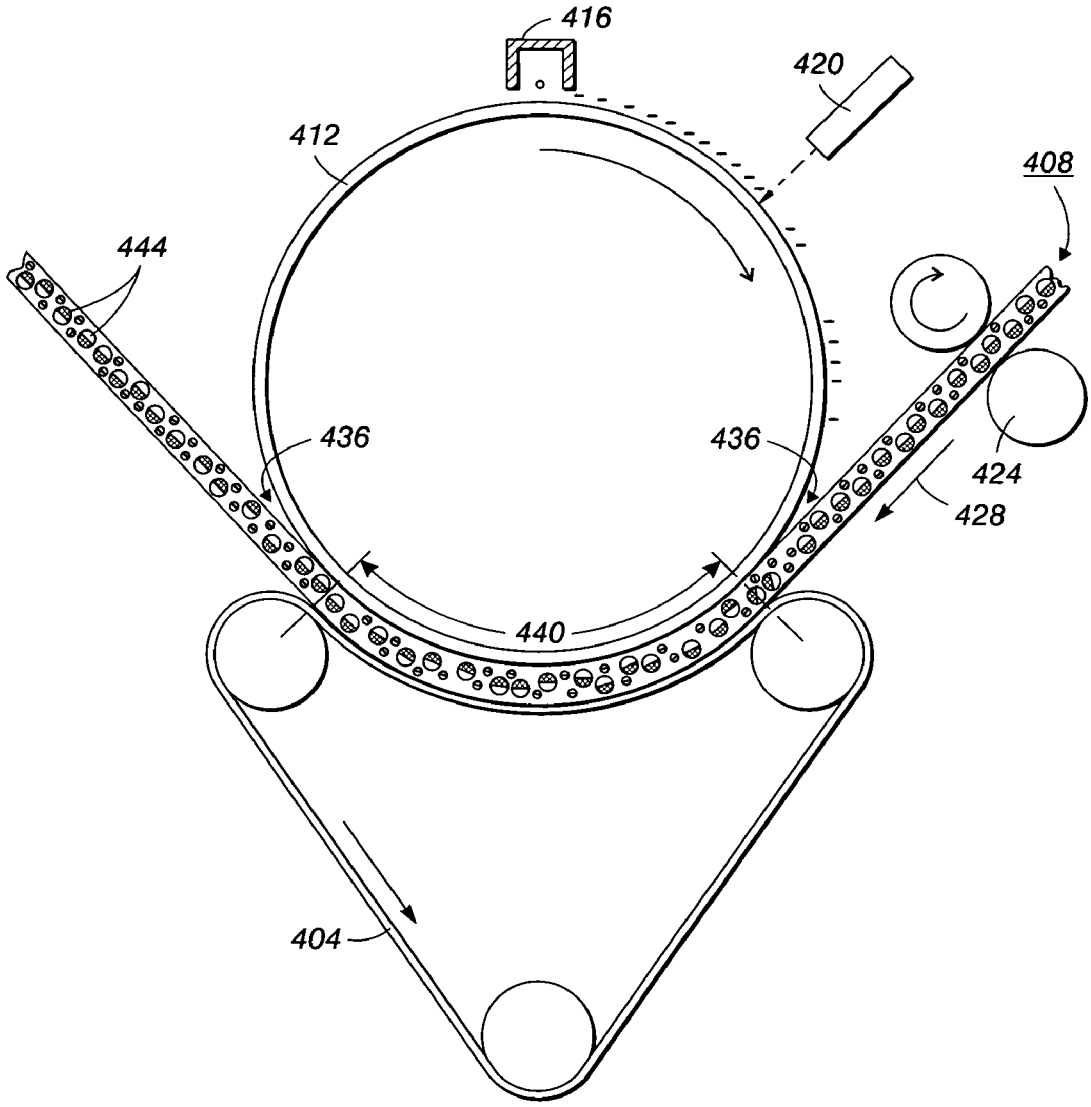
FIG. 4 shows an example electric paper printer system.

In order to increase printing speed, FIG. 4 shows a printer system in which a transfer belt 404 bend the electric paper 408 to keep a substantial area of electric paper 408 in contact with photoconductive drum 412. Each point on photoconductive drum 412 remains in contact with a corresponding point on electric paper 408 for the time needed to write data onto the electric paper.

In FIG. 4, a corona charger 416 charges photoconductive drum 412 surface. A laser beam, light emitting diode, or other charge neutralizing device 420 erases or neutralizes the charge in select regions. An image processor circuit coupled to the charge neutralizing device controls charge neutralization such that the remaining charge pattern on the photoconductive drum 412 forms an image.

In some embodiments, the photoconductive drum erases the old image on electric paper 408 as it writes the new image. However, more typically, charge neutralized regions of drum 412 do not write to the electric paper at all. In such cases, separate erase stations 424 may be used to uniformly erase any content on the electric paper prior to writing by photoconductive drum 412.

As electric paper 408 moves in the direction indicated by arrow 428, electric paper 408 first contacts the photoconductive drum 412 at contact point 432. As the drum rotates along direction 436, the electric paper moves at a corresponding speed such that each point on the photoconductive drum 412 remains in contact with a corresponding electric paper 408 point. After electric paper passes through release point 436, the electric paper and the drum surface separates. The contact time is approximately contact length 440 (the paper path distance from contact point 432 to release point 436) divided by the speed of electric paper 408. This contact time should be sufficient for an electrical characteristic (in this case, the charge generated electric field) to fully write to each pixel of the electric paper. In one example. The contact time is the time to fully rotate microsphere 444. Typical contact times are 400 milliseconds.

Once the image has been written, eraser 448 erases or otherwise resets the charge distribution on photoconductive drum 412. Drum resetting allows writing additional images or completion of an image.

Figure 5:
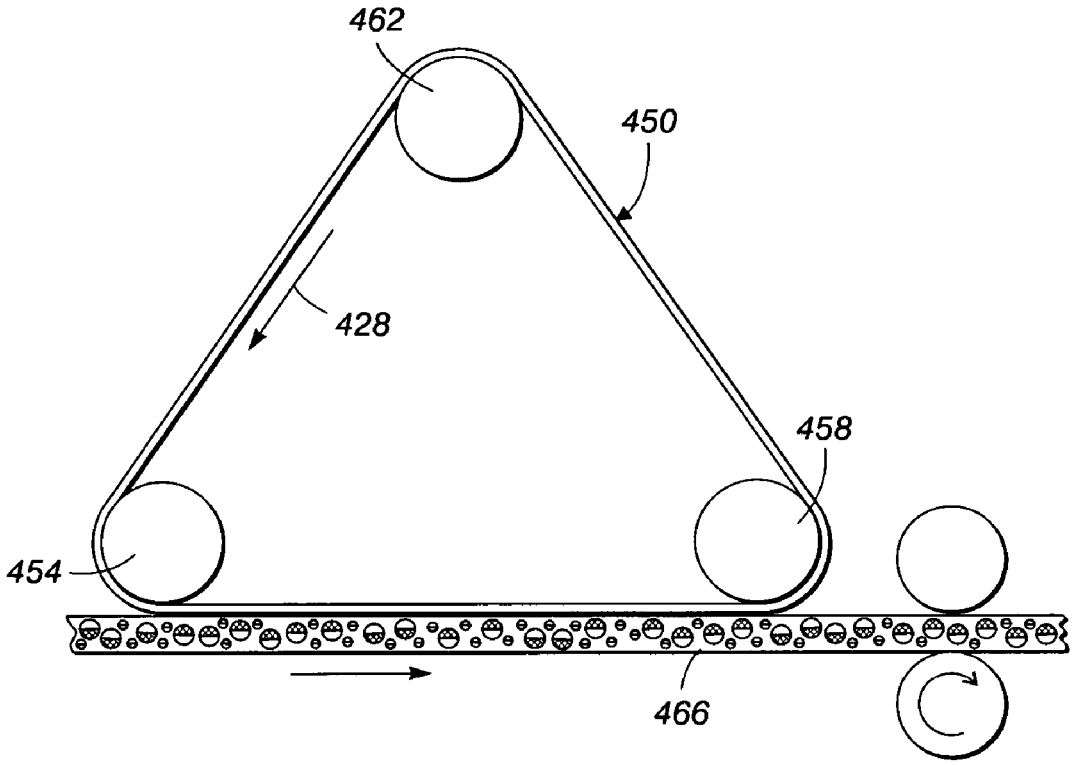
FIG. 5 shows an alternative architecture for an electric paper printer system.

In FIG. 4, the drum surface moves with the electric paper. In particular, the photoconductive drum rotation directly corresponds to electric paper movement. However, many other architectures may be used to move a printer surface in tandem with the motion of the electric paper. FIG. 5 shows a belt 450 that has a charge distribution representing an image. Rollers 454, 458, 462 move belt 450 and electric paper 470 together thereby extending the length of time in which each charge on belt 450 remains in contact with electric paper 470. As in FIG. 4, the extended contact period allows the electric paper to respond to the electric field without slowing down the printing process. Drums, rollers, lasers and belts add size and bulk to the printing system. Thus, in alternate structures it may be undesirable to move the writing instrument surface with the electric paper. In such a system, an electronic method of shifting the charge across the writing instrument surface to keep an electrical characteristic, such as a charge created electrical field, constant over a particular point on the electric paper may be desirable.

Figure 6:
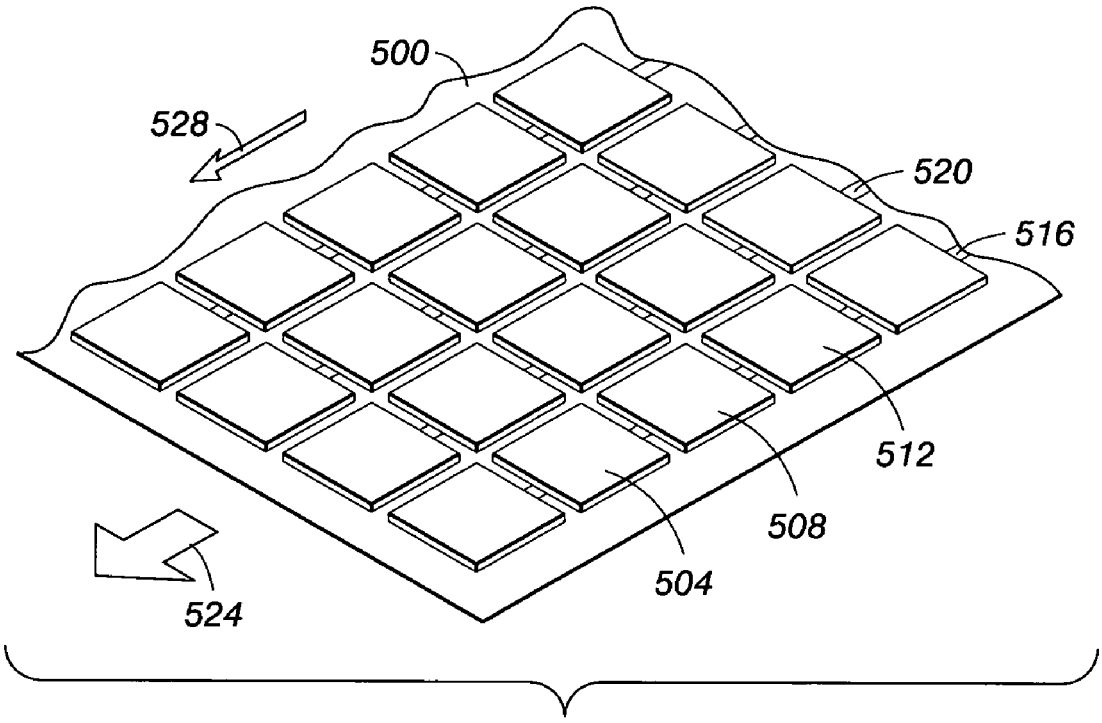
FIG. 6 shows a time domain integration imaging system including a two dimensional array of write elements.

FIG. 6 shows a time domain integration (TDI) imaging system in which a two dimensional surface 500 includes an array of actuators or writing elements 504, 508, 512. The writing elements are coupled together in columns, such as column 516 and column 520. A writing characteristic, such as an electric charge that generates an electric field or a pixel writing electric current, may be passed down from write element to adjacent write element in an electronic equivalent to a "bucket brigade".

Each actuator or writing element may be a pixel driver such as a charge coupled device (CCD). Each writing element outputs an electrical characteristic that writes to the electric paper. The electrical writing characteristic depends on the type of electric paper used. In particular, the writing characteristic as used herein is defined as the electrical characteristic used to set an image in the electric paper. For example, in an electrochromic paper, the writing characteristic is a current. In a gyricon paper, the writing characteristic is an electric field.

In one example, a sheet of electric paper moves along direction 524. In an alternate embodiment, the array of writing elements is incorporated into a "wand" or other print head type of structure that moves over the electric paper. Whether the electric paper moves, the printing elements in a wand moves, or both move simultaneously, a relative motion is created between the electric paper and the writing elements. A motion sensor or other sensing mechanism may be used to determine the direction and speed of the relative motion. Alternately, the speed and direction of the relative motion may be know from the paper handling mechanism that feeds and controls motion of the electric paper or the structure that moves the writing elements. In either case, information on the speed and direction of the relative motion is communicated to electronics that control TDI imager output. The TDI imager adjusts each writing element such that the writing characteristic output by a column of writing elements shifts in the same direction 528 as the relative electric paper motion. The shift rate is adjusted to result in an effective "speed" of the writing characteristic. This "effective speed" approximately matches the relative speed of the electric paper with respect to the writing elements. By matching speeds, the imager effectively integrates the writing characteristic by the number of writing elements in a column.

Using the described system enables much higher print speeds. For example, gyricon electric paper utilizes spheres that have typical rotation times on the order of 100 milliseconds or longer. A simple linear array of actuators printing a 11.5 length paper at 300 dpi with a 100 ms reaction time would take over five minutes a page. (300 dots per inch×11.5 inches×100 ms/pixel) However, a column of 600 write elements could reduce the print time enabling a theoretical print speed of 110 pages per minute.

A secondary benefit of the time domain integration system results from writing element averaging. A long pixel column means that each printed pixel is a result of many writing elements. In a system where each printed pixel results from several hundred writing elements, failure of a single writing element usually has a negligible effect on image contrast. (For example, the failure of a sphere to rotate by $1/100^{th}$ is usually negligible) In the event that the effect is nonnegligible, electronics can disable actuators in other columns to correct the problem. In particular, disabling a corresponding number of writing elements in other columns removes any contrast differentials which may result.

Large area electronics technologies may be used to form the two dimensional array of writing elements. Possible technologies include solution processed electronics, polymer organics, short-chain organics, amorphous silicon, and laser crystallized polysilicon among others. Transfer of signals from writing element to adjacent writing element in a column may be achieved by bucket brigade electronics that actually transfer a signal in the direction of electric paper motion. Alternately, pixel-drive electronics may simply turn writing elements on and off as the electric paper moves such that each electric paper pixel is consistently under an "on" write element or an "off" write element.

Figure 7:
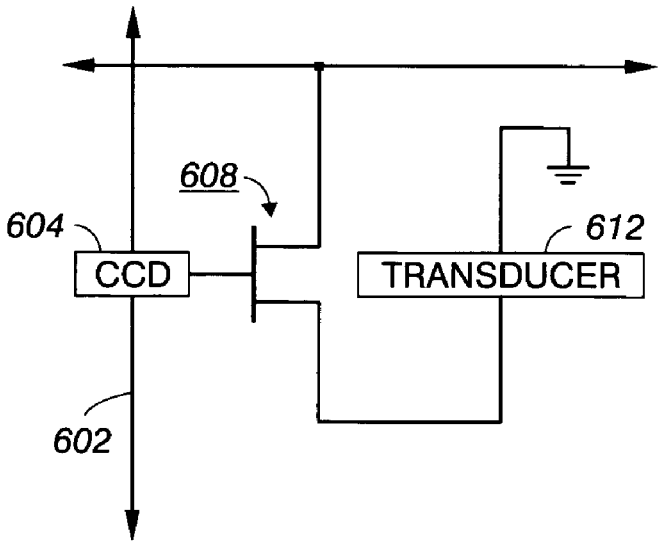
FIG. 7 shows one example of a charge coupled device for that may be used as a write element.
Figure 8:
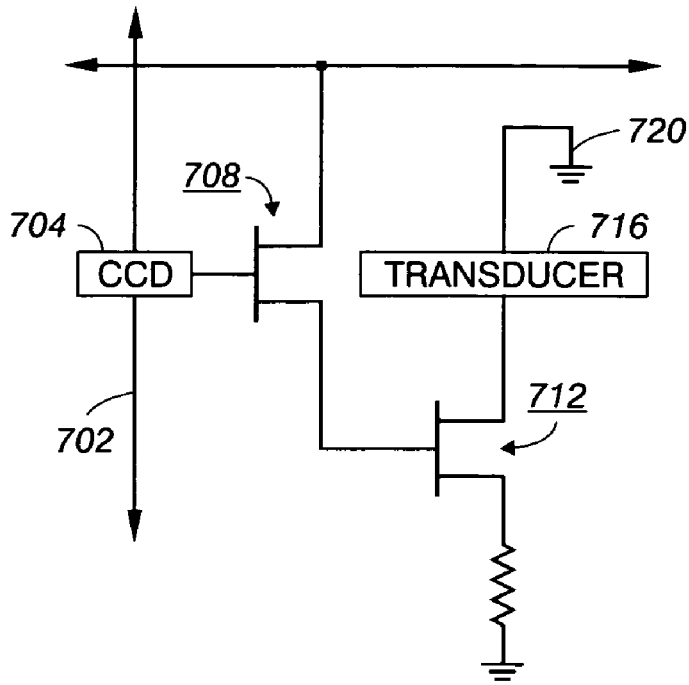
FIG. 8 shows an alternative example of a charge coupled device that may be used as a write element.

FIGS. 7 and 8 show two example circuits that may be used in a writing element implementation. FIG. 7 shows an amorphous silicon driver circuit for printing electric field actuated electric paper. In FIG. 7, a signal from a printing control circuit switches a charge coupled device (CCD) 604. CCD 604 controls the switching of amorphous silicon transistor 608. When a high electric field is needed, CCD 604 turns on transistor 608 which allows charge accumulation on transducer 612. The charge may be coupled to an electrode including pads, springs or other methods for communicating an electric field to the electric paper.

FIG. 8 shows an alternative embodiment of a current driver for a charge actuated electric paper. In FIG. 8, a printing control circuit switches CCD 704. CCD 704 switches transistor 708. When transistor 708 is switched on, transistor 708 turns on transistor 712 which drains current from transducer 716. Transducer 716 may be coupled to an electrode, including pads, springs or other methods for draining or applying electric current to or from the electric paper common contact 720 usually attached to a backside or side pads of the electric paper.

In an analog implementation of the printing system, analog shift registers may be used. Analog shift registers shift charge from write element to adjacent write element such that the electric field generated by the analog charge moves with the electric paper motion. Thus an approximately constant charge remains positioned over the electric paper as it moves through the printer.

Figure 9:
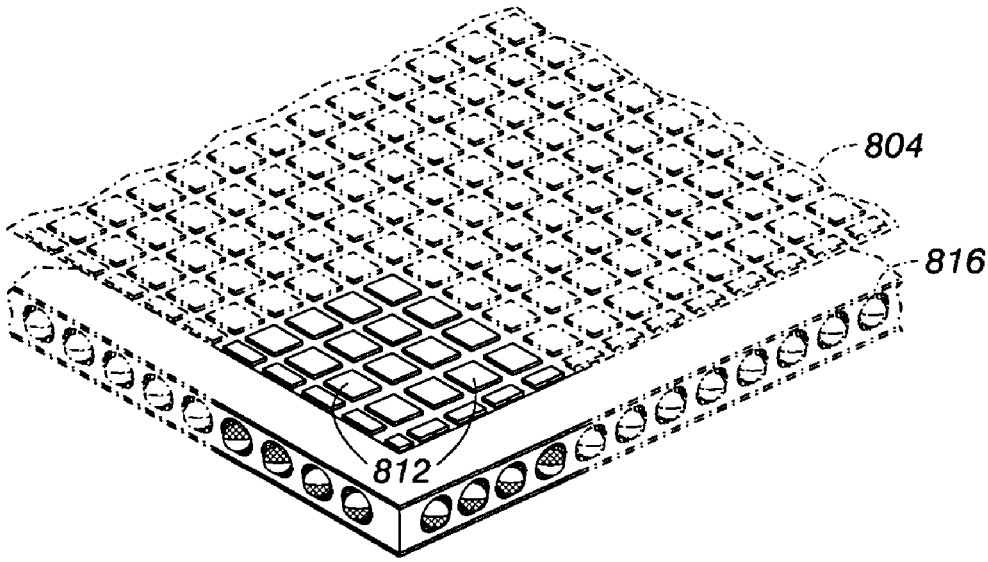
FIG. 9 shows a large array of write elements that approximately matches the size of the electric paper sheet.

In a very large array of write elements, a form of "electronic lithography" may be performed. FIG. 9 shows a sheet 804 of write elements that approximately matches the size of an electric paper sheet 816. In FIG. 9, sheet 804 of write elements 812 is placed over electric paper sheet 816. Electric paper sheet 816 is held stationary for at least the period of time it takes for electric paper to fully react to the write elements. For example, in a gyricon electric paper sheet where the response time of each sphere is 100 ms, the electric paper is kept stationary for at least 100 ms. The use of one large sheet of write elements avoids the used of shift registers and circuitry to coordinate write characteristic pixel movements with electric paper movement.

The preceding description describes various methods of improving and accelerating printing to electric paper. The description includes electric papers moving through printers, although it should be understood that it is just as easy to move a wand or other printing device over the electric paper instead. The description also includes a number of details such as speeds, example circuits, example types of electric paper, and example response times. The details are provided as examples and facilitate understanding of ways in which the invention may be implemented. These details should not be used to limit the invention. Instead, the invention should only be limited by the claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An electric paper printer comprising:

a two dimensional array of electric paper printing elements, each electrical paper printing element to output an electrical characteristic, the electric characteristic to set the color of a pixel on a sheet of electric paper;

an apparatus to create a relative motion at the time of marking between a sheet of electric paper and printing elements marking the electric paper; and, circuitry to adjust the electrical characteristics of the two dimensional array of electric paper printer elements such that a particular electrical write characteristic approximately tracks a corresponding pixel of the electric paper for a duration of time that the corresponding pixel remains approximately adjacent the two dimensional array of electric paper printer elements.

2. An electric paper printer comprising:

a two dimensional array of electric paper printing elements, each electrical paper printing element to output an electrical characteristic, the electric characteristic to set the color of a pixel on a sheet of electric paper;

an apparatus to create a relative motion during printing between a sheet of electric paper and printing elements marking the electric paper; and, circuitry to adjust the electrical characteristics of the two dimensional array of electric paper printer elements such that a particular electrical write characteristic approximately tracks a corresponding pixel of the electric paper for a duration of time that the corresponding pixel remains approximately adjacent the two dimensional array of electric paper printer elements, wherein the electrical characteristics move across the surface of the two dimensional array of electric paper printing elements and a speed approximately matching the speed of the electric paper.

3. The electric paper printer of claim 2 where a shift register is used to move the electrical characteristics across the surface of the two dimensional array of electric paper printing elements.

4. The electric paper printer of claim 2 wherein the control circuit individually addresses each electric paper printing elements and switches each electric paper printing element to keep a constant electrical characteristic applied to a pixel of the electric paper as the electric paper moves across the two dimensional array of electric paper printing elements.

5. The electric paper printer of claim 1 wherein the electrical characteristic is an electric field.

6. The electric paper printer of claim 5 wherein the electric field is generated by charged fixed on a rotating drum.

7. The electric paper printer of claim 5 wherein the electric field is generated by charge that moves across the surface of the two dimensional array of electric paper printing elements.

8. The electric paper printer of claim 1 wherein the electrical characteristic is an electric current that alters charges on a pixel of the electric paper.

9. The electric paper printer of claim 1 wherein the electric paper includes rotatable spheres.

10. The electric paper printer of claim 1 wherein the apparatus to create a relative motion is a paper handler that moves the electric paper through the printer.

11. The electric paper printer of claim 1 wherein the apparatus to create a relative motion includes a system for moving a wand that includes the two dimensional array of electric printing elements over a surface of the electric paper.

12. A method of printing electric paper comprising:

creating a relative motion during printing between a sheet of electric paper and a two dimensional array of electric paper printing elements such that the electric paper moves at a predetermined velocity different from a velocity of the two dimensional array of electric paper printing elements; and, adjusting the movement of an electrical characteristic across the two dimensional array of electric printer elements such that a particular electrical write characteristic that determines the color of a pixel on the electric paper approximately tracks a corresponding electric paper pixel for the duration of time that the corresponding electric paper pixel remains approximately adjacent the two dimensional array of electric paper printing element.

13. The method of printing of claim 12 wherein the adjusting of the electrical characteristic includes the operation of shifting during printing a plurality of charges in a column of shift registers such that the charges shift in a direction approximately parallel to a direction of travel of the electric paper.

14. The method of printing of claim 12 wherein the adjusting of the electrical characteristic includes the operation of sequentially switching on a series of electric paper printing elements in a column of electric paper printing elements, the timing of the switching of each electric paper printing element to approximately match an arrival of a pixel on the electric paper at each electric paper printing element.

15. The method of printing of claim 12 wherein the electrical characteristic is an electric field.

16. The method of printing of claim 12 wherein the electrical characteristic is a current that adjusts charge on the electric paper.

17. The method of printing of claim 12 wherein the electric paper includes a plurality of rotatable elements, each electric paper printing element to control rotation of the plurality of rotatable elements.

18. The method of printing of claim 12 wherein the two dimensional array is a surface of a rotating drum such that the two dimensional array moves with the electric paper.

19. The method of printing of claim 12 wherein a sensor detects the motion of the electric paper and communicates the motion to circuitry that adjusts the electrical characteristic.

20. The electric paper printer of claim 1 wherein the apparatus to create a relative motion during printing keeps the speed of the electric paper during printing at 0 and moves only the two dimensional array of electric paper printing elements during printing.

21. The electric paper printer of claim 1 wherein the apparatus to create a relative motion during printing keeps the speed of the electric paper printing elements during printing at 0 and moves only the electric paper during printing.

22. The method of printing of claim 12 wherein the relative motion during printing keeps the speed of the electric paper during printing at 0 and moves only the two dimensional array of electric paper printing elements during printing.

23. The method of printing of claim 12 wherein the apparatus to create a relative motion during printing keeps the speed of the electric paper printing elements during printing at 0 and moves only the electric paper during printing.

24. The electric paper printer of claim 1 wherein the change in color is from white to black.

* * * * *